US009802101B1

(12) United States Patent
Brown

(10) Patent No.: US 9,802,101 B1
(45) Date of Patent: Oct. 31, 2017

(54) APPARATUS AND METHOD FOR COUNTING ATTEMPTS IN A SPORTING GAME

(71) Applicant: Tobias Brown, McCordsville, IN (US)

(72) Inventor: Tobias Brown, McCordsville, IN (US)

( * ) Notice: Subject to any disclaimer, the term of this patent is extended or adjusted under 35 U.S.C. 154(b) by 35 days.

(21) Appl. No.: 14/716,851

(22) Filed: May 19, 2015

Related U.S. Application Data

(60) Provisional application No. 62/000,507, filed on May 19, 2014.

(51) Int. Cl.
*A63B 69/00* (2006.01)
*A63B 71/06* (2006.01)

(52) U.S. Cl.
CPC ..... *A63B 71/06* (2013.01); *A63B 69/0071* (2013.01); *A63B 2220/17* (2013.01)

(58) Field of Classification Search
CPC ..... A63B 69/0059; A63B 69/0071; A63B 69/3608; A63B 71/06; A63B 2220/17; A63B 2220/836; A63B 2243/0037; A63B 2071/0663
USPC ..... 473/450
See application file for complete search history.

(56) References Cited

U.S. PATENT DOCUMENTS 4,337,049 A 6/1982 Connelly
4,637,732 A 1/1987 Jones et al.
4,805,905 A * 2/1989 Haub ..... A63B 69/0071 473/450
4,919,425 A * 4/1990 Wolf ..... A63B 69/0071 473/450
5,149,085 A * 9/1992 Sanchez ..... A63B 23/14 473/450
5,236,190 A * 8/1993 Moss ..... A63B 69/0071 472/56
5,827,126 A * 10/1998 Lee ..... A63B 69/3608 473/213
6,144,620 A * 11/2000 dePoortere ..... G04G 21/025 368/108
6,389,368 B1 5/2002 Hampton
6,554,724 B2 4/2003 Taylor
6,945,882 B2 9/2005 Strong
8,845,461 B2 * 9/2014 Duke ..... A63B 69/0071 473/447
9,474,953 B1 * 10/2016 Duke ..... A63B 69/0071
2003/0058744 A1 * 3/2003 Calace ..... A63B 71/0605 368/109
2006/0160639 A1 7/2006 Klein
(Continued)

*Primary Examiner* — Milap Shah
(74) *Attorney, Agent, or Firm* — R. Randall Frisk

(57) ABSTRACT

An apparatus for counting attempts in a sporting game includes a housing with a display for displaying at least a running count of attempts; wrist band means having opposing first and second sides, being connected at the first side with the housing, and being sized and configured to encircle a person's wrist proximal the person's palm; an input contact member mounted at the second side of the wristband means for movement upon contact with the person's palm; an attempt input assembly operably connected with the input contact member to transmit an electrical signal upon detecting movement of the input contact member by the palm; and electronic processing and power elements for receiving input from the attempt input assembly and causing the display to display information related to the movement registered by the input contact member.

7 Claims, 5 Drawing Sheets

(56) References Cited

U.S. PATENT DOCUMENTS

| | | | | |
|---|---|---|---|---|
| 2006/0199659 | A1* | 9/2006 | Caldwell | A63B 69/3608 473/221 |
| 2007/0066415 | A1* | 3/2007 | Hou | A63B 69/3608 473/219 |
| 2007/0173355 | A1 | 7/2007 | Klein | |
| 2008/0015061 | A1 | 1/2008 | Klein | |
| 2011/0045925 | A1* | 2/2011 | Moye | A63B 24/0006 473/450 |
| 2011/0130227 | A1* | 6/2011 | Chen | A63B 69/0071 473/450 |
| 2012/0316011 | A1* | 12/2012 | Milosevic | G09B 19/0038 473/450 |
| 2012/0322587 | A1* | 12/2012 | Duke | A63B 69/0071 473/450 |

* cited by examiner

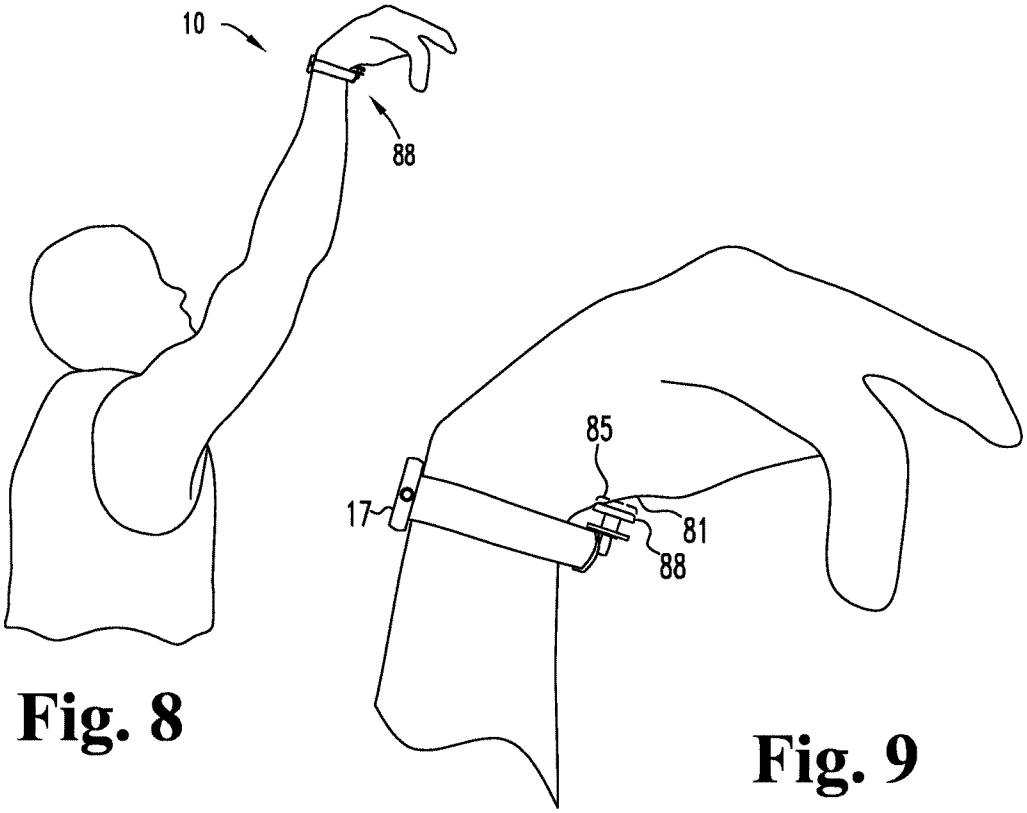
Fig. 8
Fig. 9
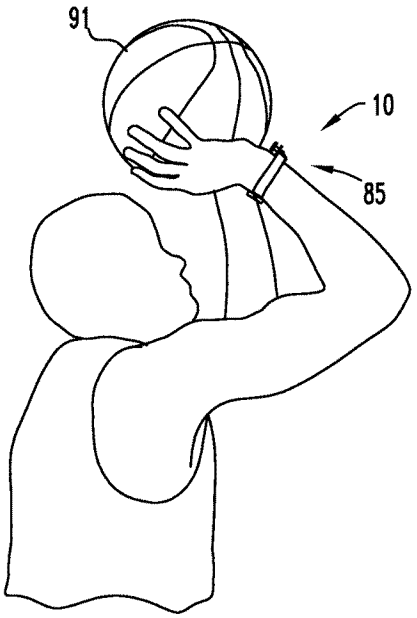
Fig. 7

APPARATUS AND METHOD FOR COUNTING ATTEMPTS IN A SPORTING GAME

REFERENCE TO RELATED APPLICATIONS

This application claims priority from U.S. Provisional Application No. 62/000,507 filed May 19, 2014, which application is hereby incorporated by reference in its entirety.

FIELD OF THE INVENTION

The present invention relates to accessories for sporting games, and in particular, to a wrist-mounted counter for counting attempts in a sporting game.

BACKGROUND OF THE INVENTION

As with any endeavor, practice improves performance. In basketball, for example, repetition in shooting the ball from a particular location on the court develops muscle memory and mental familiarity, comfort and confidence in shooting from that spot. Players may often shoot 50, 100 or more free throws each day in practice to increase their skill and accuracy. In addition, there are shooting forms that, if maintained, will improve one's accuracy, one such form being a proper follow through of the shooting hand at the wrist. What is needed is a device that will assist a player in practicing his or her shot and in the proper form.

SUMMARY OF THE INVENTION

Generally speaking, there is provided a device for keeping a running count of basketball shots taken using the proper follow-through. The invention is also contemplated for use in myriad other sporting games or contests.

An apparatus for counting attempts in a sporting game includes a housing with a display for displaying at least a running count of attempts; wrist band means having opposing first and second sides, being connected at the first side with the housing, and being sized and configured to encircle a person's wrist proximal the person's palm; an input contact member mounted at the second side of the wristband means for movement upon contact with the person's palm; an attempt input assembly operably connected with the input contact member to transmit an electrical signal upon detecting movement of the input contact member by the palm; and electronic processing and power elements for receiving input from the attempt input assembly and causing the display to display information related to the movement registered by the input contact member.

It is an object of the present invention to provide an improved device for assisting a player in practicing shot attempts in a sporting game, such as basketball.

Further objects and advantages of the present invention will become apparent from the following description of the preferred embodiment.

BRIEF DESCRIPTION OF THE DRAWINGS

FIG. 7 is a side view of a user 89 preparing to shoot a basketball 91 while wearing the apparatus 10 of FIG. 1, apparatus 10 being in the fully extended (non-signal input) position 85.

FIG. 8 is a side view of the user 89 of FIG. 7 having shot the basketball and properly engaged the apparatus 10 of FIG. 1, it now being in a depressed (signal generating) position 88.

FIG. 9 is an enlarged view of the user's hand and wrist of FIG. 8 and showing apparatus 10 in a depressed (signal generating) position 88.

DESCRIPTION OF THE PREFERRED EMBODIMENT

Figure 2:
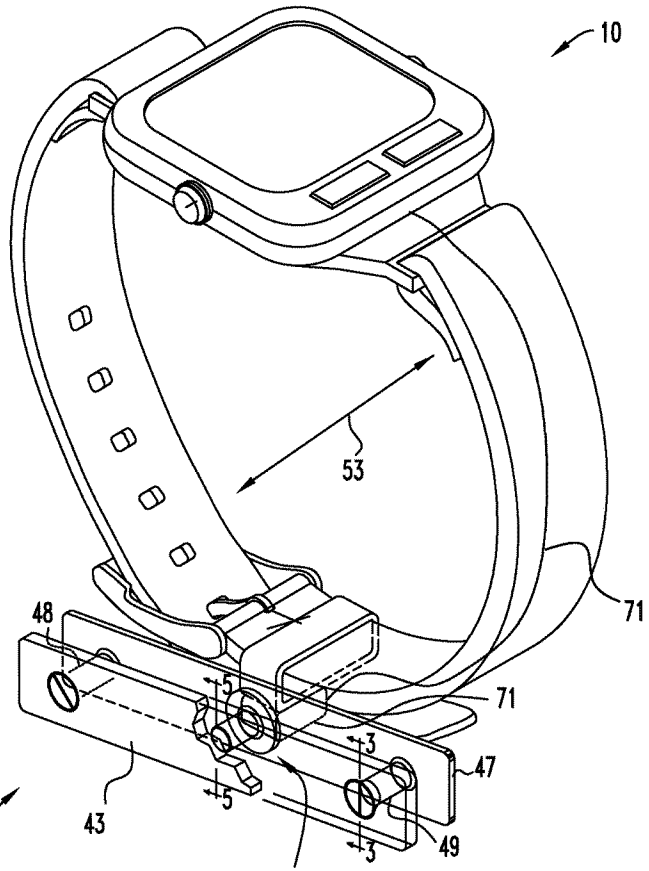
FIG. 2 is a front, perspective view of the apparatus for counting attempts in a sporting game 10 of FIG. 1 and with portions of the input contact member 43 broken away for clarity in discussion.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 1:
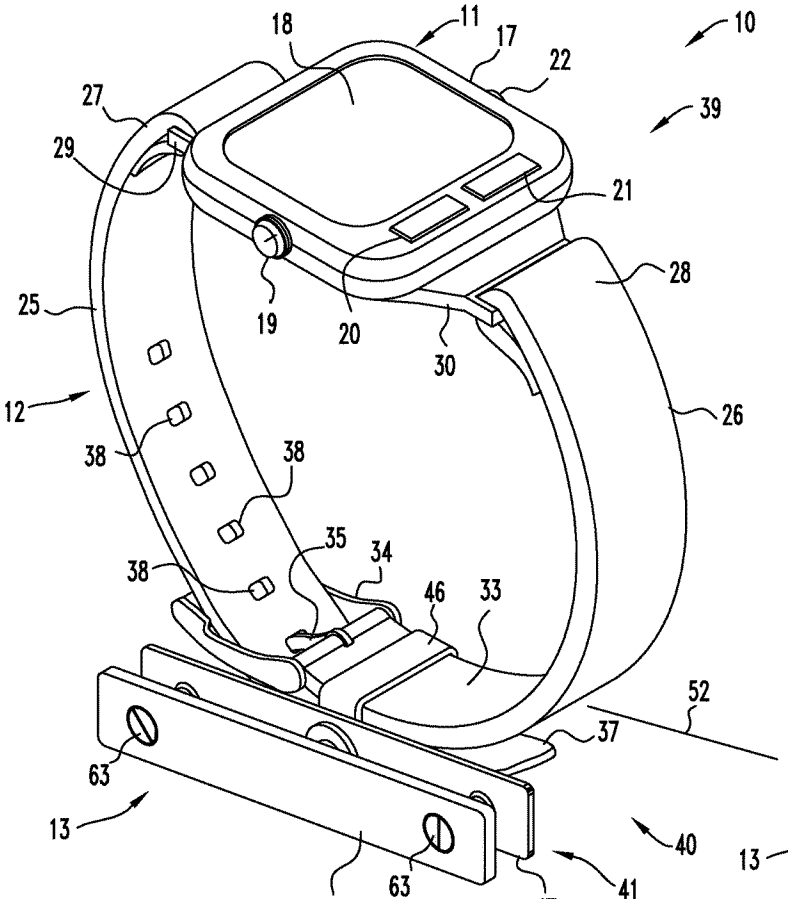
FIG. 1 is a front, perspective view of an apparatus for counting attempts in a sporting game 10 in accordance with one embodiment of the present invention.

Referring to FIG. 1, there is shown an apparatus for counting attempts in a sporting game 10—also referred to herein as a shot counter 10—in accordance with one embodiment of the present invention. The present embodiment is described as being primarily for use in counting shots while practicing free throw shooting in basketball, but the invention contemplates application for counting shots from anywhere on the court, as well as for making layups, conducting passing drills and virtually any basketball action or skill. The invention also contemplates application in virtually any other sport, such as counting passes attempted in football, pitches or any throw attempted in baseball, shots or passes attempted in hockey, etc. The invention is described for use in counting attempts in a sporting game. The latter phrase is intended to broadly encompass any pastime, amusement, or sport, or competitive, non-competitive or other activity where practice can enhance one's skill, accuracy and performance.

The shot counter 10 of FIG. 1 has the form factor of a wrist watch and includes a main body 11, a wristband 12 and an attempt input assembly 13. Main body 11 is much like any wrist watch in that it has a housing 17, a display 18, one or more control input buttons 19-22, and electronic processing and power elements (not shown). The electronic processing and power elements are located inside housing 17 and, like typical watches, they are configured and operate to display via the electronically connected display 18 whatever data or information is programmed therein. The display 18 may be any appropriate element configured to display the desired data or information from the electronic processing and power elements, such display, for example, being based on LED, LCD or any available and appropriate display technology.

Wristband 12 comprises first and second strap elements 25 and 26, which are connected at their proximal ends 27 and 28 to an opposing ears 29 and 30 of housing 17. Like a standard watch band, at the distal end 33 of one strap element 26 is connected a square ring 34 and pin 35, and the distal end 37 of the other strap element 25 is sized to fit within and through the square ring 34 and also defines a series of spaced-apart holes 38 through which can extend pin 35 to secure the distal end 37 to distal end 33 when strap elements 25 and 26 encircle a person's wrist in a generally oval or circular configuration. When so encircling a person's wrist, wristband 12 forms a generally circular configuration with opposing sides 39 and 40. At the first, top side 39 is connected the housing 17, which is to be facing up and normally readily visible by the wearer. At the second, opposing and typically lower side 40 of the generally circular wristband 12 is mounted the attempt input assembly 13, and thus registrable input to shot counter 10 which is to be maintained in a running count by the present invention is intended to be made at the underside of the wrist, near the lower part of the person's palm 81 (FIG. 9).

Referring to FIGS. 1-4, attempt input assembly 13 includes a mounting assembly 41, an input registration assembly 42, and an input contact member 43. The mounting assembly 42 includes a bracket 46 that is securely connected to the distal end 33 of second strap element 26, here by tightly encircling it and being bonded to it with an adhesive. Mounting assembly 42 also includes a back plate 47 and opposing guide posts 48 and 49. Back plate 47 is about two inches long and is securely connected to bracket 46 so that its length is generally parallel to a line that 52 that, when wristband 12 is fastened around someone's wrist, such line 52 is generally tangential to the wristband at a position on the side 40 of the generally circular wristband 12 that is opposite from the housing 17, as shown in FIG. 1.

The guide posts 48 and 49 are identical, are mounted on opposing ends of back plate 47 and extend sideways therefrom, mutually parallel and parallel to a forearm line 53 that here generally represents the direction of a person's forearm on which shot counter 10 is mounted or worn. Each post includes a sleeve 56 that extends through a hole 57 defined in back plate 47. Each sleeve 56 has a head 59 that engages with the back side of back plate 47 and also defines a threaded bore 62 on its opposite end. A screw 63 threads into the threaded bore 62 of each sleeve 56.

Input contact member 43 is an elongate plate or bar having an elongate shape similar to that of back plate 47, it also being about two inches long. At its opposing ends, input contact member 43 defines two identical holes (one shown at 66 in FIGS. 3 and 4), through which extends a mating one of the sleeves 56 of guide posts 48 and 49, as shown. The holes (one shown at 66), are sized large enough to permit input contact member 43 to slide easily along the mutually parallel sleeves 56 of guide posts 48 and 49.

As described herein, input contact member 43 will be positioned to be engaged by the lower part of the user's palm 81. To better ensure an input-registering contact of the palm 81 to input contact member 43, the input contact member 43 is made long (here about two inches), and the clearance between holes 66 and the outer diameters of sleeves 56 is made somewhat large (in one embodiment, about 0.04 inches) so that input contact member 43 can be depressed (pushed) generally at one end more than the other (that is—the pushing input of the lower portion of palm 81 may be offset and only push at one end, by post 49, for example), yet input contact member 43 will still move far enough to depress plunger 71, as discussed herein.

Figure 3:
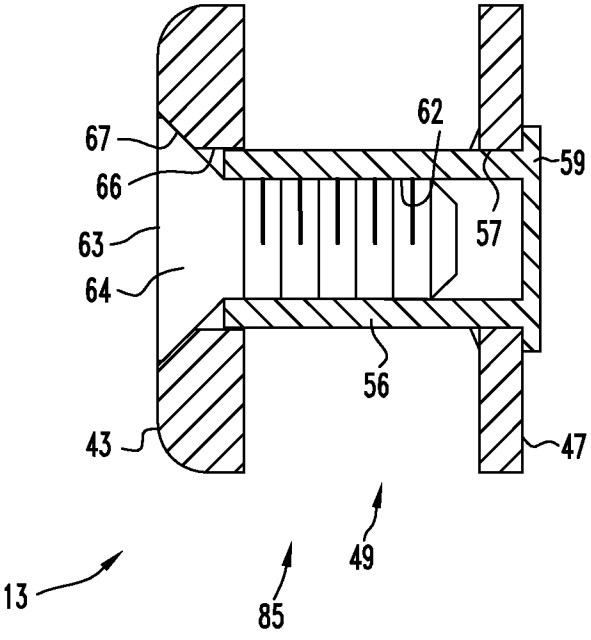
FIG. 3 is a side, cross-sectional view of the attempt input assembly 13 of apparatus 10 of FIG. 2 taken along the lines 3-3 and viewed in the direction of the arrows and with attempt input assembly 13 in the fully extended (non-signal input) position 85.

The heads 64 of screws 63 are beveled, and the holes 66 of input contact member 43 are counter bored at their out ends (at 67) so that input contact member 43 can rest all the way out (all the way to the left, as shown in FIG. 3) and the screw heads 64 thus sit within the complementary shaped holes 66. Other configurations for the heads of the screws 63 and the recesses in input contact member 43 are contemplated. For example, the screw heads can be flat headed screws and the counter bores will instead be squared, rather than beveled recesses.

Figure 6:
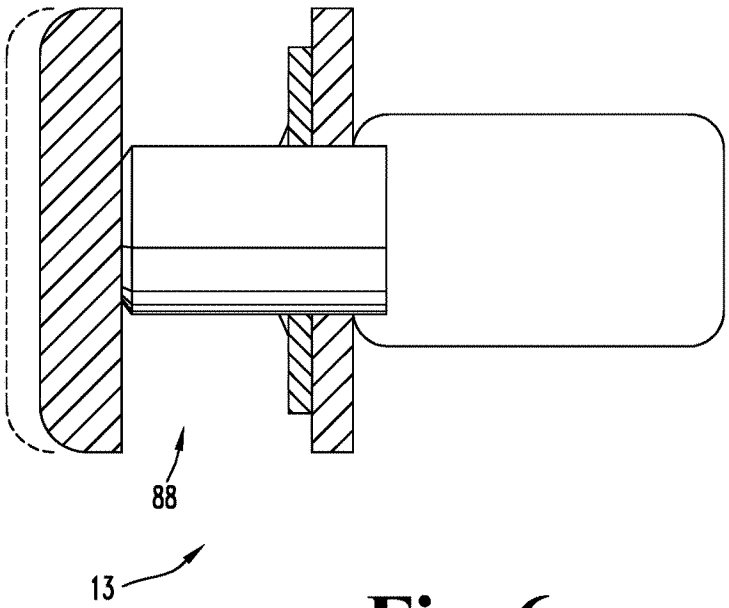
FIG. 6 is a side, cross-sectional view of the attempt input assembly 13 of FIG. 5 and with attempt input assembly 13 in a depressed position 88.
Figure 5:
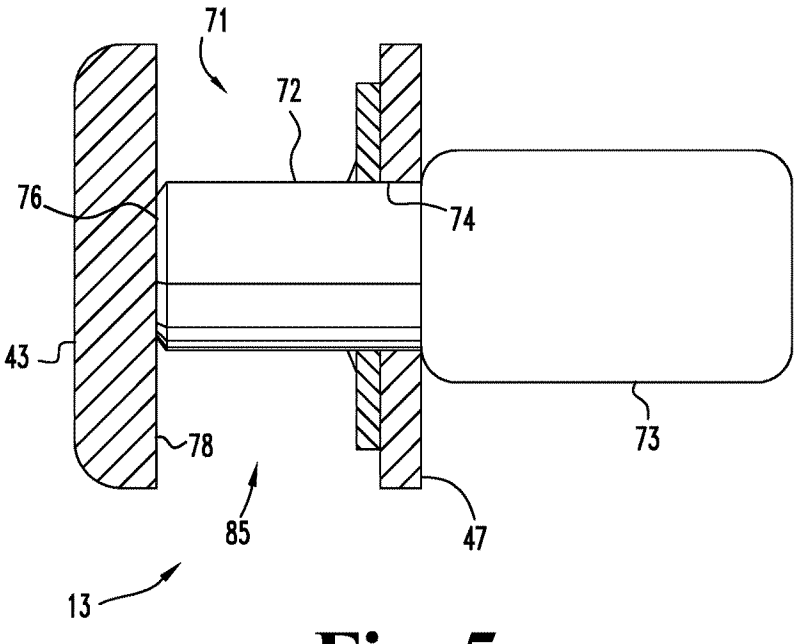
FIG. 5 is a side, cross-sectional view of the attempt input assembly 13 of apparatus 10 of FIG. 2 taken along the lines 5-5 and viewed in the direction of the arrows and with attempt input assembly 13 in the fully extended (non-signal input) position 85.

Referring to FIGS. 2, 5 and 6, input registration assembly 42 includes a plunger switch 71 that is mounted to the underside of bracket 46, with the plunger 72 of plunger switch 71 extending sideways, through a hole 72 in back plate 47, and parallel to and generally midway between the sleeves 56 of posts 48 and 49, as shown. The body 73 of plunger switch 71 is immobile relative to back plate 47, and when spring-biased plunger 72 is in its outermost (no-input) position, its outer end 76 engages with the back side 78 of input contact member 43 and, thus urges input contact member 43 all the way out (to the left in FIG. 3, and as shown in FIGS. 1 and 2). And, by virtue of the screw heads 64 engaging input contact member 43, screws 63 and their sleeves 56 are likewise urged all the way out until their heads 59 engage with the back of back plate 47 (FIG. 3). The output signal from plunger switch 71 is transmitted through appropriate wiring (77) through second strap element 26 up to housing 17 where it connects with the electronic processing and power elements located inside housing 17.

As with wrist watches, cell phones, laptops and other electronic equipment of the day, the electronic processing and power elements contained within housing 17 include a microprocessor, a power source and other electronic elements, all of which are well known in the art. The programming of such microprocessor is made to make apparatus 10 operate as follows:

The user will mount the shot counter 10 on his or her wrist with the housing 17 and display 18 on the top of the wrist and the attempt input assembly 13 on the underside of the wrist. As shown, shot counter 10 is a right handed unit so that the attempt input assembly 13 is on the underside of the wrist and disposed toward the palm 81 of the same hand (i.e. not toward the elbow). Embodiments are contemplated wherein there are both left and right handed units (the left handed units have the attempt input assembly 13 reverse-mounted, that is, on the right side of the wrist band, as viewed in FIG. 1), and embodiments are also contemplated where the attempt input assembly 13 is detachable so that it can be quickly removed from one side and mounted on the other to accommodate both left and right handed users.

With shot counter 10 mounted on the user's wrist and the attempt input assembly 13 properly facing the user's palm, the selects the desired function of shot counter 10 by pressing the appropriate combination of control input buttons 19-22. Thus the user may wish to keep a running count of free throws attempted using the proper form and so selects the free throw option. In very simple versions of shot counter 10, the only function is a simple shot counter. There would in this type of unit be only one button (e.g. 19) to reset the counter. Once selected, the user then shoots, as shown in FIG. 7. With proper follow through, the lower part of the user's palm 81 (proximal the wrist) engages and pushes against input contact member 43 (FIGS. 8 and 9). The configuration and sizing of input contact member 43, the spacing between input contact member 43 and back plate 47 and the sensitivity of plunger switch 71 combine, upon depression and movement of input contact member 43 and thus plunger 72 (from a fully extended position 85 of attempt input assembly 13 to a depressed position 88 of attempt input assembly 13) to cause plunger switch 71 to send a signal to the electronic processing and power elements, which then advances the programmed counter. The display 18 then shows the running count of shots properly registered. Should the shooter fail to properly follow through with the shooting hand so that the palm does not make contact with input contact member 43, the counter will not advance, and the shot will not be counted.

Figure 4:
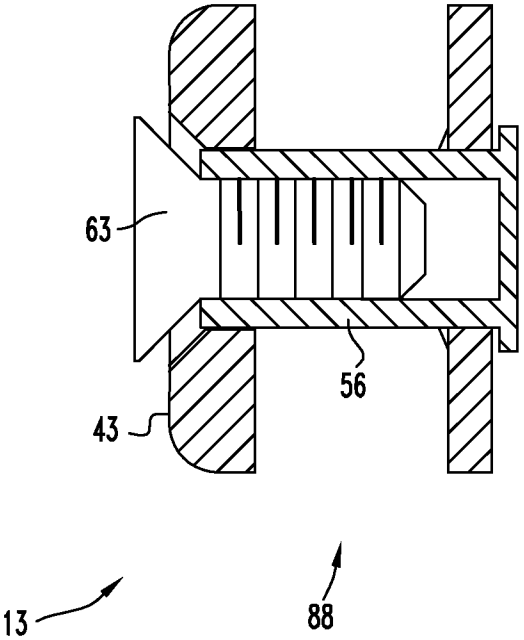
FIG. 4 is a side, cross-sectional view of the attempt input assembly 13 of FIG. 3 and with attempt input assembly 13 in a depressed position 88.

As seen in FIG. 4, either or both of the input contact member 43 and sleeve/screw 56/63 can move upon engagement of the shooter's palm.

Shot counter 10 also contemplates other features be added to the electronic processing and power elements. With a wrist watch, added functions are often referred to as complications. Thus, shot counter 10 contemplates added functions (complications) such as the ability to then register when the attempted shot is made, or what kind of shots are being attempted, such as two pointers, three pointers, and so on. Such additional complications could also include configuration for other sports (baseball, football, tennis, golf, etc.) and, of course, in other embodiments, one or more time keeping functions are added. Thus, in one embodiment, a watch, preferably a sports watch, the button/counter function would be one of many functions the watch is designed to perform along with other functions, such as: a standard timekeeper, a stopwatch, a count-down timer, an alarm, a heart monitor, etc.

Figure 10:
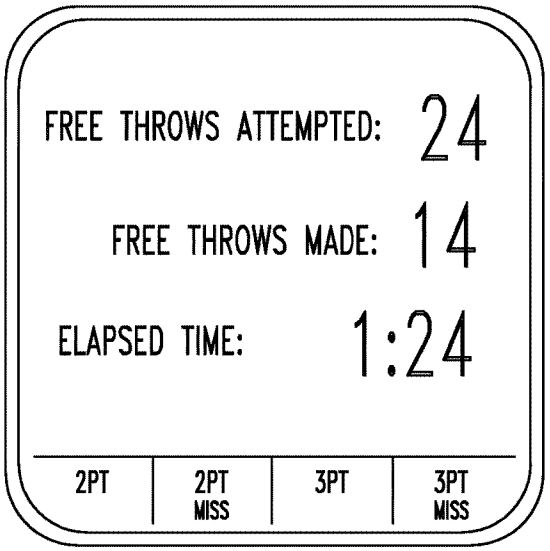
FIG. 10 is a view of the display 18 showing one form of data displayed by shot counter 10.

In one embodiment, sensors applied at the basketball goal register if the shot is made, and a wireless signal is sent to the electronic processing and power elements of the apparatus 10, which contains a transceiver to receive and process such data, and then register it on the display, as shown in FIG. 10.

Alternative embodiments are contemplated wherein wristband 12 comprises other configurations, for example, a single strap connected at its opposing ends to the ears 29 and 30 of housing 17 and that is resilient and stretches enough to enable it to be pulled over one's hand and onto the wrist. In another embodiment, wristband 12 could comprise a single strap that is connected at one end to an ear 29 of housing 17 and has a connection element configured to engage and connect with a mating connection element mounted directly on or made a part of the housing 17, such second, mating connection element being opposite the first ear 29 (that is, where ear 30 of housing 17 of FIG. 1 is located). Alternative embodiments are also contemplated wherein strap elements 25 and 26 or single strap or other configuration(s) comprise a self-connecting material (such a one with hooks and loops, such as Velcro®) or comprise a metal with appropriate fasteners therefor.

Figure 11:
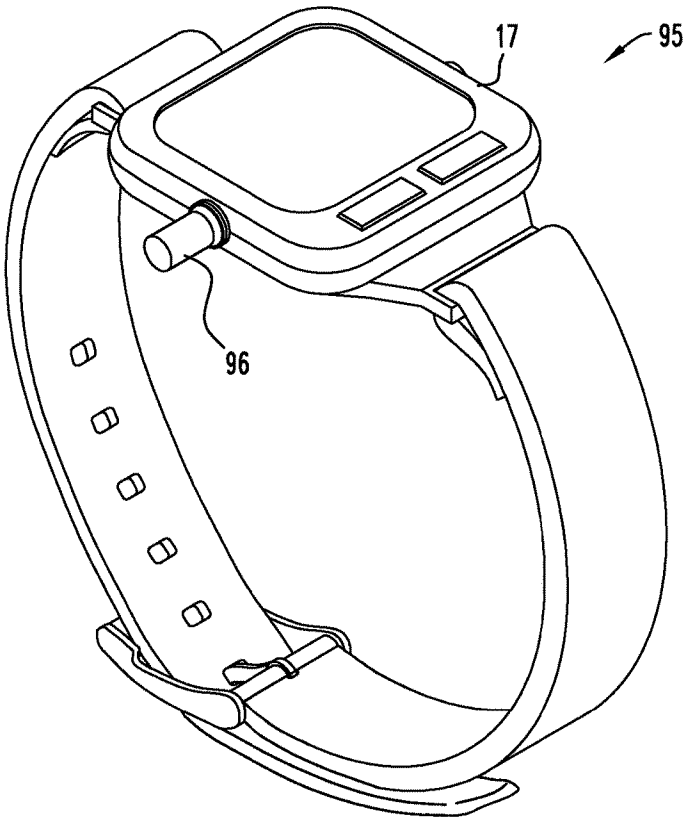
FIG. 11 is a front, perspective view of an apparatus counting attempts in a sporting game 95 in accordance with another embodiment of the present invention.

Referring to FIG. 11, there is shown is an apparatus for counting attempts in a sporting game 95 in accordance with another embodiment of the present invention. Here, instead of the attempt input assembly 13 being mounted on the second, opposite side 40 of the wristband 12, housing 17 includes the plunger element 96 (of a plunger switch assembly) as a combined unit. In use, the user reverses the shot counter 95 so that the plunger 96 is located on the underside of the wrist and so that the person's palm contacts and depresses the plunger 96 to register a properly executed shot and follow through.

While the invention has been illustrated and described in detail in the drawings and foregoing description, the same is to be considered as illustrative and not restrictive in character, it being understood that only the preferred embodiment and limited additional embodiments have been shown and described and that all changes and modifications that come within the spirit of the invention are desired to be protected. It is specifically intended that the present invention not be limited to the embodiments and illustrations contained herein.

I claim:

1. An apparatus for counting attempts in a sporting game, comprising:

a housing with a display for displaying at least a running count of attempts;

wrist band means having opposing first and second sides, being connected at the first side with said housing, and being sized and configured to encircle a person's wrist proximal the person's palm;

an input contact member mounted at the second side of said wristband means for movement upon contact with the person's palm;

an attempt input assembly operably connected with said input contact member to transmit an electrical signal upon detecting movement of said input contact member by the palm; and electronic processing and power elements for receiving input from said attempt input assembly and causing the display to display information related to the movement registered by said input contact member.

2. The apparatus for counting attempts in a sporting game of claim 1 wherein the input contact member includes a plunger depressible by the person's palm and upon a completion of a predetermined movement of the person's palm.

3. The apparatus for counting attempts in a sporting game of claim 1 wherein the input contact member includes plate mounted for movement upon contact with the person's palm and upon a completion of a predetermined movement of the person's palm.

4. The apparatus for counting attempts in a sporting game of claim 3 wherein the input contact member includes a plunger mounted for depressible movement to said attempt input assembly to cause the transmission of the electrical signal upon completion of the predetermined movement of the person's palm.

5. The apparatus for counting attempts in a sporting game of claim 4 wherein the plate is mounted proximal the plunger to mechanically transmit its movement by the person's palm directly to cause simultaneous movement of the plunger.

6. The apparatus for counting attempts in a sporting game of claim 5 wherein said input contact member includes a pair of spaced apart guide posts mounted to said wrist band means and the plate is mounted for sliding movement along the guide posts.

7. The apparatus for counting attempts in a sporting game of claim 6 wherein the plunger is juxtaposed between the guideposts such that the plate can be moved along either or both of the guideposts and such movement will depress the plunger and cause transmission of the electrical signal.

* * * * *